US012305640B2

(12) United States Patent
von Gynz-Rekowski et al.

(10) Patent No.: US 12,305,640 B2
(45) Date of Patent: May 20, 2025

(54) PARTICLE ADJUSTING DRILLING ASSEMBLY AND METHOD

(71) Applicant: Workover Solutions, Inc., Imperial, PA (US)

(72) Inventors: Gunther H H von Gynz-Rekowski, Montgomery, TX (US); Russell Wayne Koenig, Conroe, TX (US)

(73) Assignee: Workover Solutions, Inc., Imperial, PA (US)

( * ) Notice: Subject to any disclaimer, the term of this patent is extended or adjusted under 35 U.S.C. 154(b) by 0 days.

(21) Appl. No.: 18/335,126

(22) Filed: Jun. 14, 2023

(65) Prior Publication Data

US 2024/0418041 A1 Dec. 19, 2024

(51) Int. Cl.
*F04C 2/107* (2006.01)
*E21B 4/02* (2006.01)
(Continued)

(52) U.S. Cl.
CPC ..... *F04C 18/1075* (2013.01); *E21B 4/02* (2013.01); *E21B 21/00* (2013.01); *F04C 2/1071* (2013.01);
(Continued)

(58) Field of Classification Search
CPC ..... F04C 2/16; F04C 2/1071; F04C 2/1073; F04C 2/1075; F04C 13/008;
(Continued)

(56) References Cited

U.S. PATENT DOCUMENTS 4,495,073 A * 1/1985 Beimgraben ..... E21B 21/002 166/227
6,045,070 A * 4/2000 Davenport ..... E21B 41/0057 241/60
(Continued)

FOREIGN PATENT DOCUMENTS

CN 106593862 A 4/2017

OTHER PUBLICATIONS

Drilling Tools International, Inc., Drill Pipe Mud Screens, 2022.
(Continued)

*Primary Examiner* — Theresa Trieu
(74) *Attorney, Agent, or Firm* — Jones Walker LLP

(57) ABSTRACT

A drilling assembly includes a particle adjusting mechanism upstream of a positive displacement motor. The motor includes a metal stator, a metal rotor at least partially disposed within the metal stator, and a motor gap defined between the sealing line of the metal rotor and the lobes of the metal stator. The particle adjusting mechanism adjusts a solid particle condition of a media flowing therethrough into a treated condition in which any remaining solid particles will travel through the motor gap without widening the motor gap to a failure gap size that causes the metal rotor to lock up or to rotate inefficiently slow. The particle adjusting mechanism adjusts the solid particle condition by removing, reducing a size, reducing a dimension, deforming, modifying a shape, dissolving, or chemically reacting at least a portion of any solid particles contained in the media. The drilling assembly is suited for high temperature wellbores.

30 Claims, 14 Drawing Sheets

(51) Int. Cl.

| | |
|---|---|
| ***E21B 21/00*** | (2006.01) |
| ***F04C 13/00*** | (2006.01) |
| ***F04C 18/107*** | (2006.01) |
| *F04C 2/16* | (2006.01) |

(52) U.S. Cl.
CPC ..... *F04C 2/16* (2013.01); *F04C 13/008* (2013.01); *F04C 2230/602* (2013.01); *F04C 2240/10* (2013.01); *F04C 2240/20* (2013.01)

(58) Field of Classification Search
CPC ..... F04C 18/1075; F04C 2230/602; F04C 2240/10; F04C 2240/20; E21B 4/02; E21B 21/00
See application file for complete search history.

(56) References Cited

U.S. PATENT DOCUMENTS

| | | | | |
|---|---|---|---|---|
| 6,223,906 | B1 | 5/2001 | Williams | |
| 6,598,685 | B1 * | 7/2003 | Mashburn | E21B 21/002 166/227 |
| 7,188,687 | B2 * | 3/2007 | Rudd | E21B 7/20 175/171 |
| 7,243,740 | B2 | 7/2007 | Frith | |
| 8,408,304 | B2 * | 4/2013 | Hummes et al. | E21B 36/00 166/302 |
| 2004/0112642 | A1 * | 6/2004 | Krueger | E21B 21/08 175/312 |
| 2004/0262044 | A1 | 12/2004 | Schaaf | |
| 2007/0251729 | A1 | 11/2007 | Sand et al. | |
| 2009/0078422 | A1 | 3/2009 | Manson | |
| 2011/0214963 | A1 | 9/2011 | Beylotte et al. | |
| 2012/0061073 | A1 | 3/2012 | Soni et al. | |
| 2013/0062261 | A1 | 3/2013 | Bailey | |
| 2015/0321125 | A1 | 11/2015 | Jenkins et al. | |
| 2016/0333668 | A1 | 11/2016 | Xu et al. | |
| 2020/0102809 | A1 | 4/2020 | Schindler | |
| 2020/0165908 | A1 | 5/2020 | El-Mahbes et al. | |
| 2020/0300049 | A1 | 9/2020 | Edvardsen | |
| 2022/0018220 | A1 | 1/2022 | McNay | |

OTHER PUBLICATIONS

Applicant's co-pending U.S. Appl. No. 17/942,316, filed Sep. 12, 2022, titled "Drilling System with Annular Flush Separation Device and Method."

Applicant's co-pending U.S. Appl. No. 18/150,499, filed Jan. 5, 2023, titled "Downhole Separation System and Method."

International Search Report and Written Opinion, mailed Jun. 26, 2024, for corresponding International Patent Application No. PCT/US2024/023696.

* cited by examiner

PARTICLE ADJUSTING DRILLING ASSEMBLY AND METHOD

BACKGROUND OF THE INVENTION

In the process of drilling and maintaining a wellbore, drilling fluid is pumped through drilling motors, such as positive displacement motors, and other drilling and completion equipment, such as friction reduction tools, percussion hammers, turbines, and MWDs. Most drilling fluids contain solid particles (e.g., weighting material such as barite and hematite, low gravity solids such as clay and silt, fractured rock, and cuttings). Certain portions of the drilling and completion equipment are sensitive to the solid particles within the drilling fluid. For example, certain drilling motors include only metal components, which are not able to deform when drilling fluids containing solid particles flow between the metal components (in contrast to drilling motors with elastomeric stators). Instead, the solid particles often become wedged between two metal components, which causes the drilling motors to prematurely wear out or to stop rotating, thereby disabling the metal-to-metal drilling motor.

Accordingly, metal-to-metal drilling motors are not usually used in applications in which the drilling fluid contains solid particles. Instead, these tools are typically only used when the drilling fluid contains no solids, which is not favorable in most drilling applications. In applications involving solid particles in drilling fluid, drilling motors with power sections including elastomeric components are typically used. The elastomeric materials flex to enable solid particles to flow through the drilling motor. However, certain elastomer materials begin to degrade or fail at high temperatures, such as temperatures over 320° F., to which drilling tools are exposed within particular zones (i.e., high temperatures zones) of certain subterranean wellbores. In wellbores through high temperature zones, metal-to-metal drilling machines are the only option.

There is a need for a drilling system that enables the effective use of solid particles within drilling fluids, even when the drilling system is exposed to high temperatures.

DETAILED DESCRIPTION OF THE PREFERRED EMBODIMENTS

Disclosed herein is a drilling assembly including a metal-to-metal positive displacement motor and a particle adjusting mechanism configured to adjust a solid particle condition of a media flowing therethrough before the media flows into the metal-to-metal positive displacement motor. The particle adjusting mechanism may be configured to remove, reduce a size or dimension of, change a shape of, deform, dissolve, or chemically react at least a portion of any solid particles contained in the media.

Figure 1:
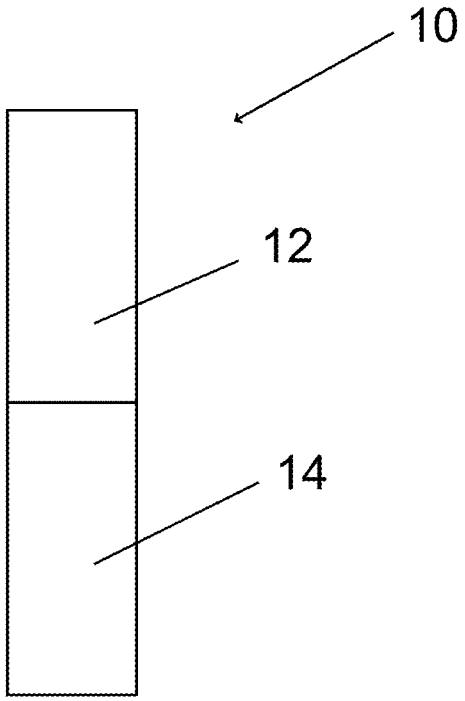
FIG. 1 is a schematic view of a drilling assembly including a particle adjusting mechanism secured upstream of a positive displacement motor.
Figure 2:
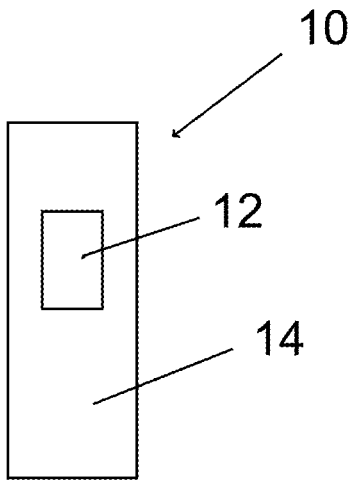
FIG. 2 is a schematic view of a drilling assembly including a particle adjusting mechanism secured within or integrated into a positive displacement motor.

FIGS. 1-13 illustrate a limited number of embodiments of the claimed drilling assembly. As illustrated in FIG. 1, drilling assembly 10 may include particle adjusting mechanism 12 operatively connected upstream of metal-to-metal positive displacement motor 14. In the embodiment of FIG. 2, drilling assembly 10 may include particle adjusting mechanism 12 disposed within or integrated into metal-to-metal positive displacement motor 14. Metal-to-metal positive displacement motor 14 may be a Moineau motor, a van motor, a screw motor, a lobe motor, or a gear motor. Metal-to-metal positive displacement motor 14 and particle adjusting mechanism 12 may have no components formed of any material that has elastic material properties, such as but not limited to polymers that are capable of recovering their original shapes after being stretched, contracted, dilated, or distorted. Metal-to-metal positive displacement motor 14 and particle adjusting mechanism 12 may also have no components that are formed of any high temperature sensitive materials, which degrade, break down, melt, or experience a change in at least one mechanical property to such an extent that the material becomes unusable in the drilling system, at temperatures above 320° F. or at temperatures between 320° F. and 1110° F., or any subrange therein.

Figure 3:
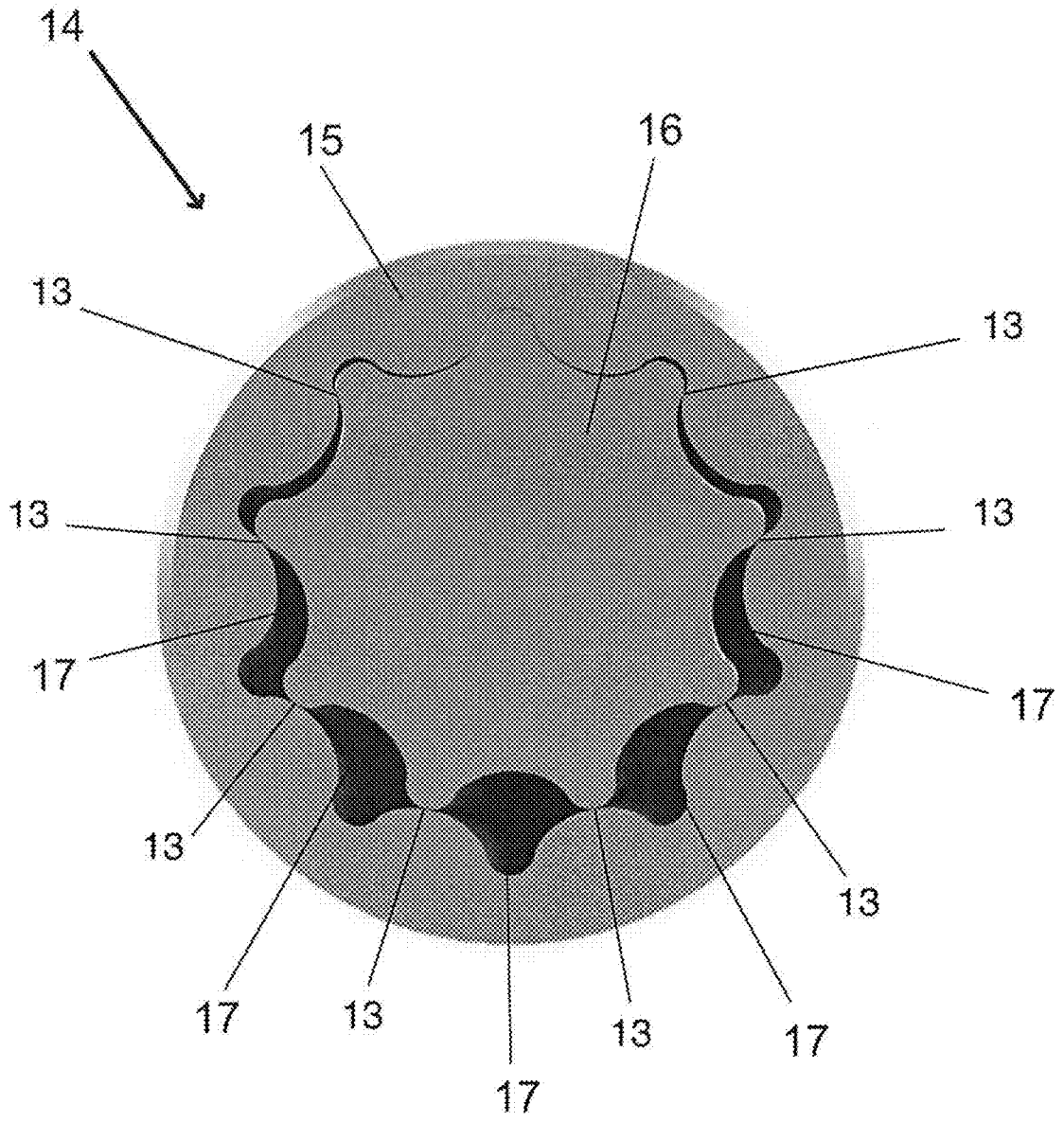
FIG. 3 is a schematic sectional view of one embodiment of a power section of a positive displacement motor of the drilling assembly disclosed herein.

Referring to FIG. 3, one embodiment of metal-to-metal positive displacement motor 14 may include a power section having a metal stator 15, a metal rotor 16 at least partially disposed within the metal stator 15, one or more cavities 17 between metal stator 15 and metal rotor 16 of the metal stator 15, and a motor gap 13 defined between the sealing line of the metal rotor 16 and the lobes of the metal stator 15. Positive displacement motor 14 may include two or more motor gaps 13. The number of motor gaps 13 depends on the number of rotor lobes. In some embodiments, each of these motor gaps 18 may be in the range of 0.005 inches to 0.020 inches when motor 14 is functioning properly. Metal stator 15 and metal rotor 16 may have any number of lobes, with metal stator 15 typically having one lobe more than metal rotor 16. In some embodiments, metal-to-metal positive displacement motor 14 may also include a transmission section and a bearing section.

Particle adjusting mechanism 12 is configured to adjust a solid particle condition of a media flowing therethrough to a treated condition in which any remaining solid particles will travel through the motor gap of metal-to-metal positive displacement motor 14 without widening the motor gap to a failure gap size. The failure gap size may be a size of the motor gap that causes the metal rotor to slow down to a reduced rotational rate (i.e., a reduced RPM) which renders drilling inefficient or to stop rotating within the metal stator altogether. In certain embodiments, the failure gap size may be greater than 0.020 inches.

For example, the solid particle condition may be an amount of solid particles, which particle adjusting mechanism 12 may be configured to adjust to a treated condition by removing and/or collecting a portion of any solid particles contained within the media. In this way, particle adjusting mechanism 12 may be configured to reduce a concentration or amount of solid particles contained within the media. Alternatively, the solid particle condition may be a size, a dimension, or a shape of any solid particles contained in the media, which particle adjusting mechanism 12 may be configured to adjust to a treated condition by reducing a size of, reducing at least one dimension of, deforming, or adjusting a shape of a portion of any solid particles contained within the media. In other embodiments, the solid particle condition may be a chemical condition of any solid particles contained in the media, which particle adjusting mechanism 12 may be configured to adjust to a treated condition by dissolving or chemically reacting a portion of any solid particles in the media. In certain embodiments, the media in the treated condition may include no remaining solid particles. In other embodiments, any remaining solid particles in the media in the treated condition may fit through the motor gap of positive displacement motor 14. In still other embodiments, the metal rotor and the metal stator of the positive displacement motor 14 may be configured to crush any remaining solid particles in the treated condition into a size or a shape that fits through the motor gap.

Figure 4:
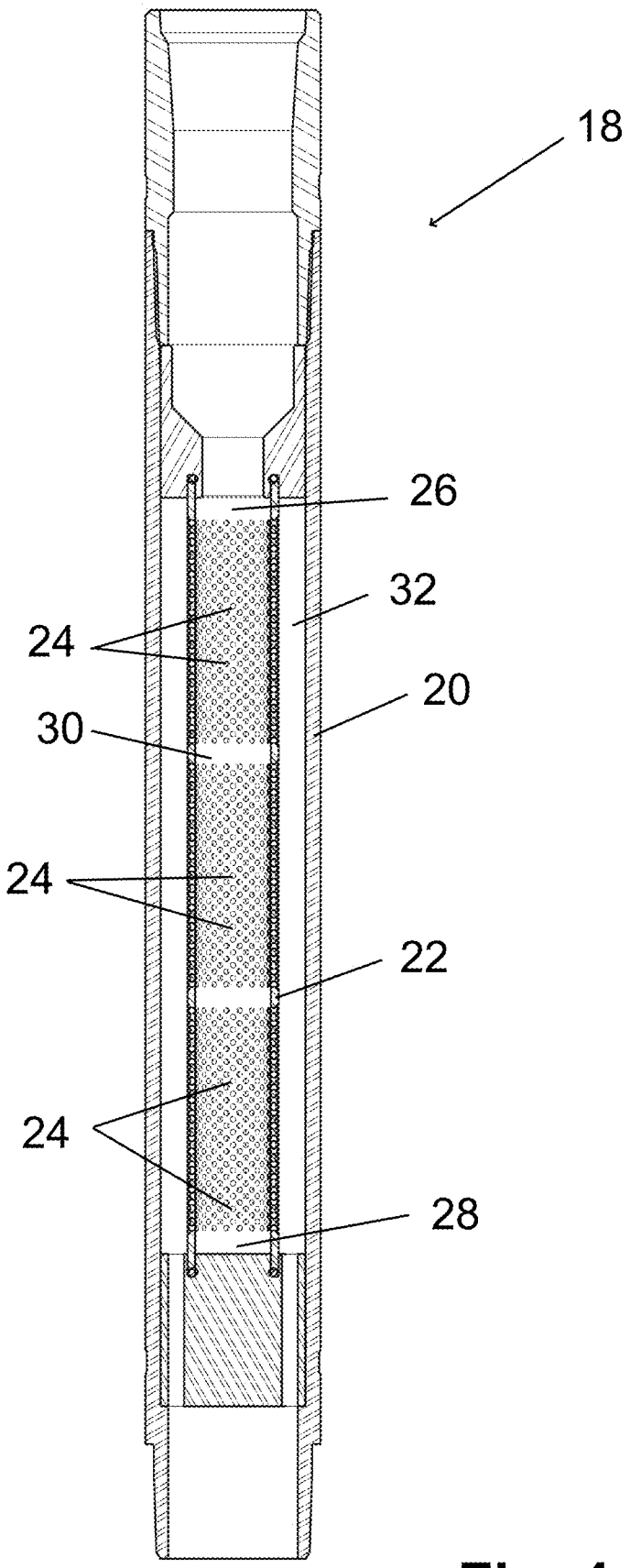
FIG. 4 is a sectional view of one embodiment of the particle adjusting mechanism including a filter.
Figure 5:
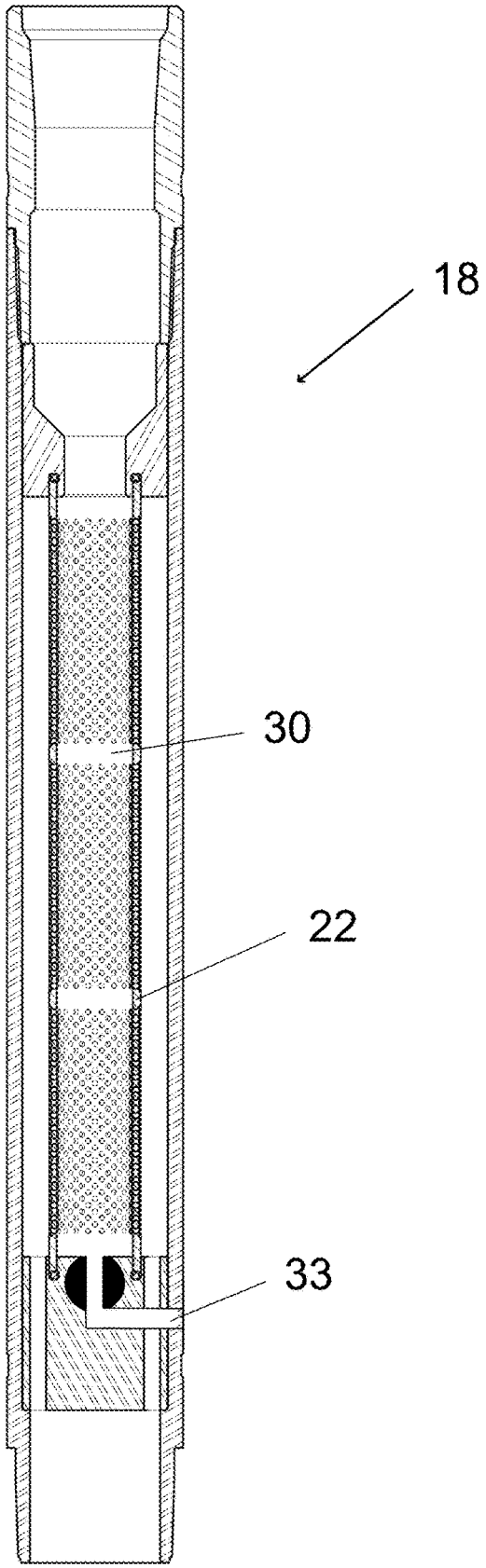
FIG. 5 is a sectional view of an alternate particle adjustment mechanism including a filter with a flush port.
Figure 6:
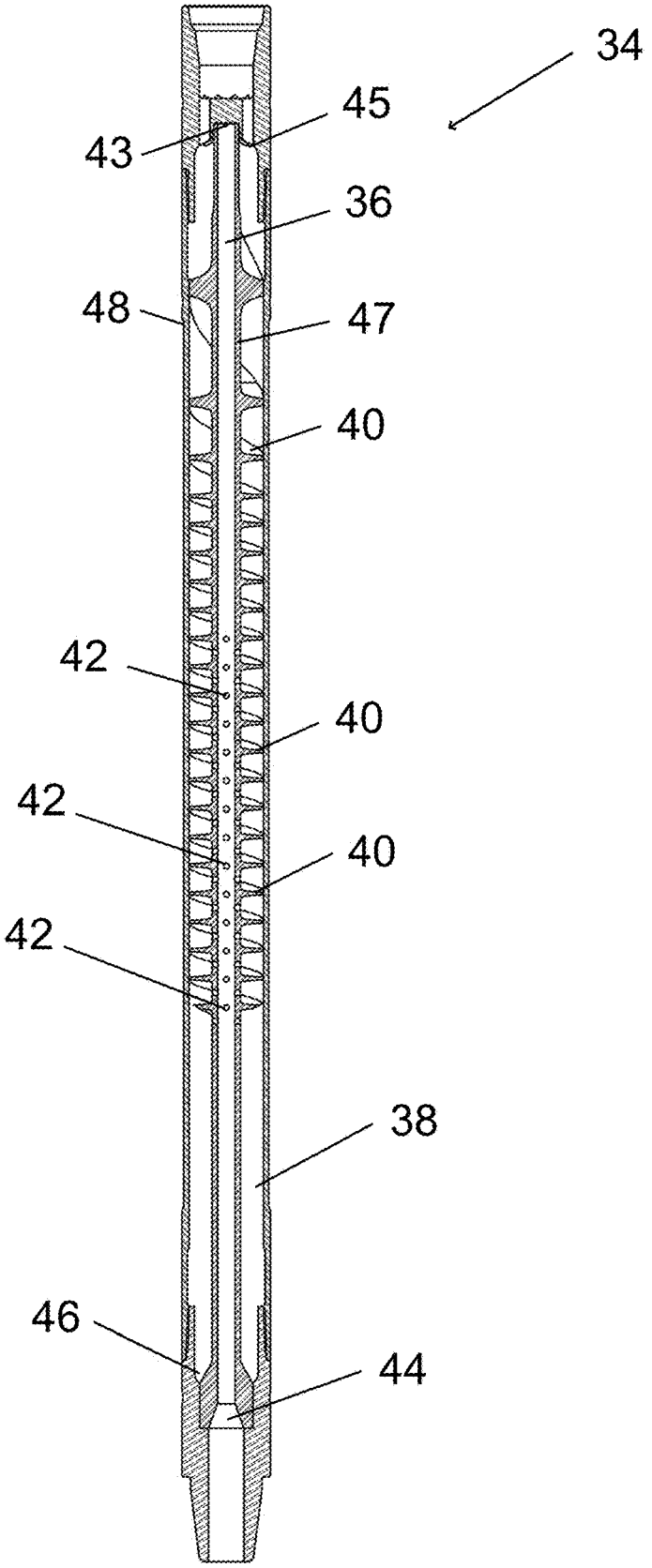
FIG. 6 is a sectional view of another embodiment of the particle adjusting mechanism including a cyclone.
Figure 7A:
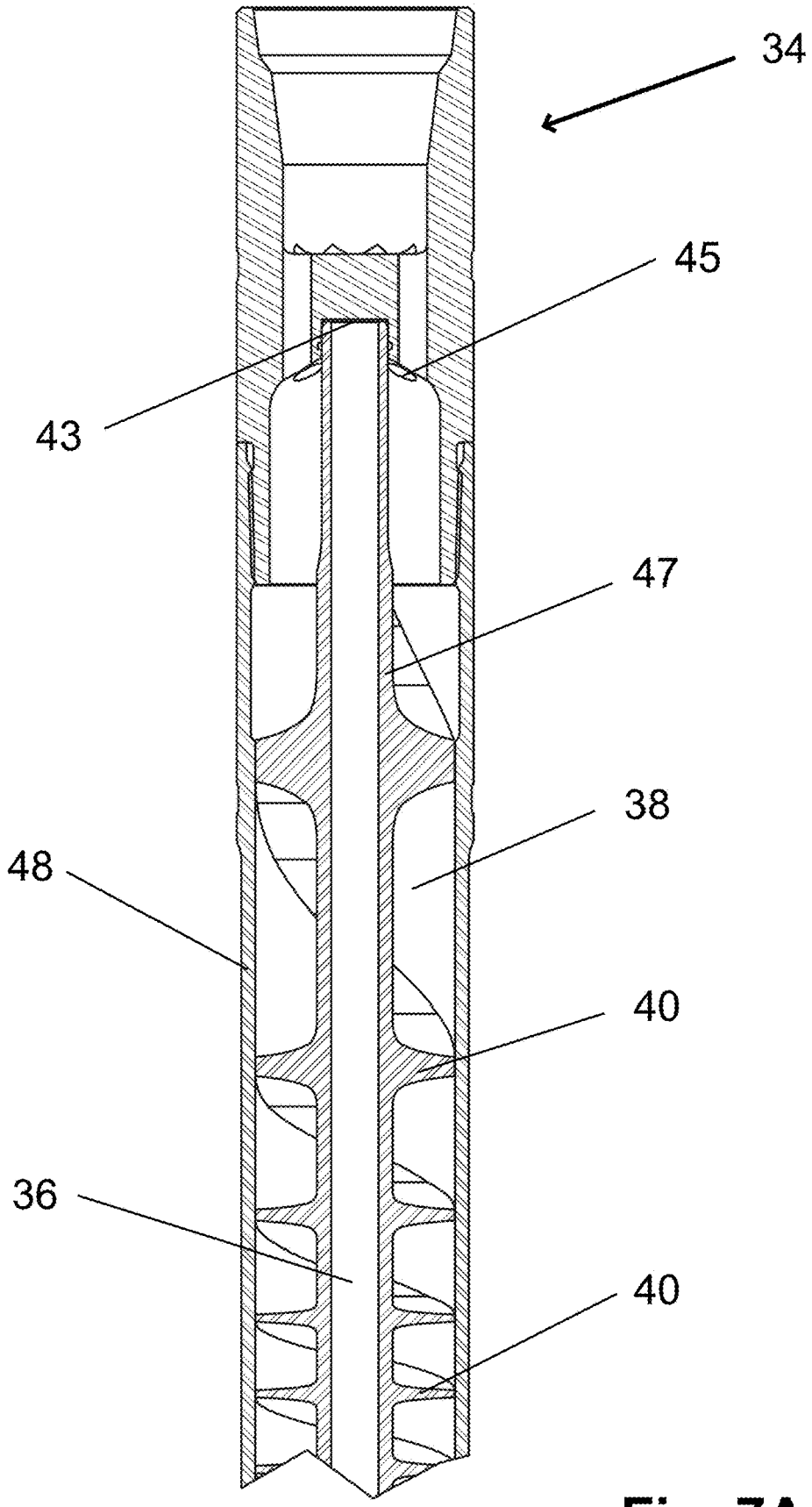
FIG. 7A is a detailed sectional view of an upper portion of the particle adjusting mechanism of FIG. 6.
Figure 7B:
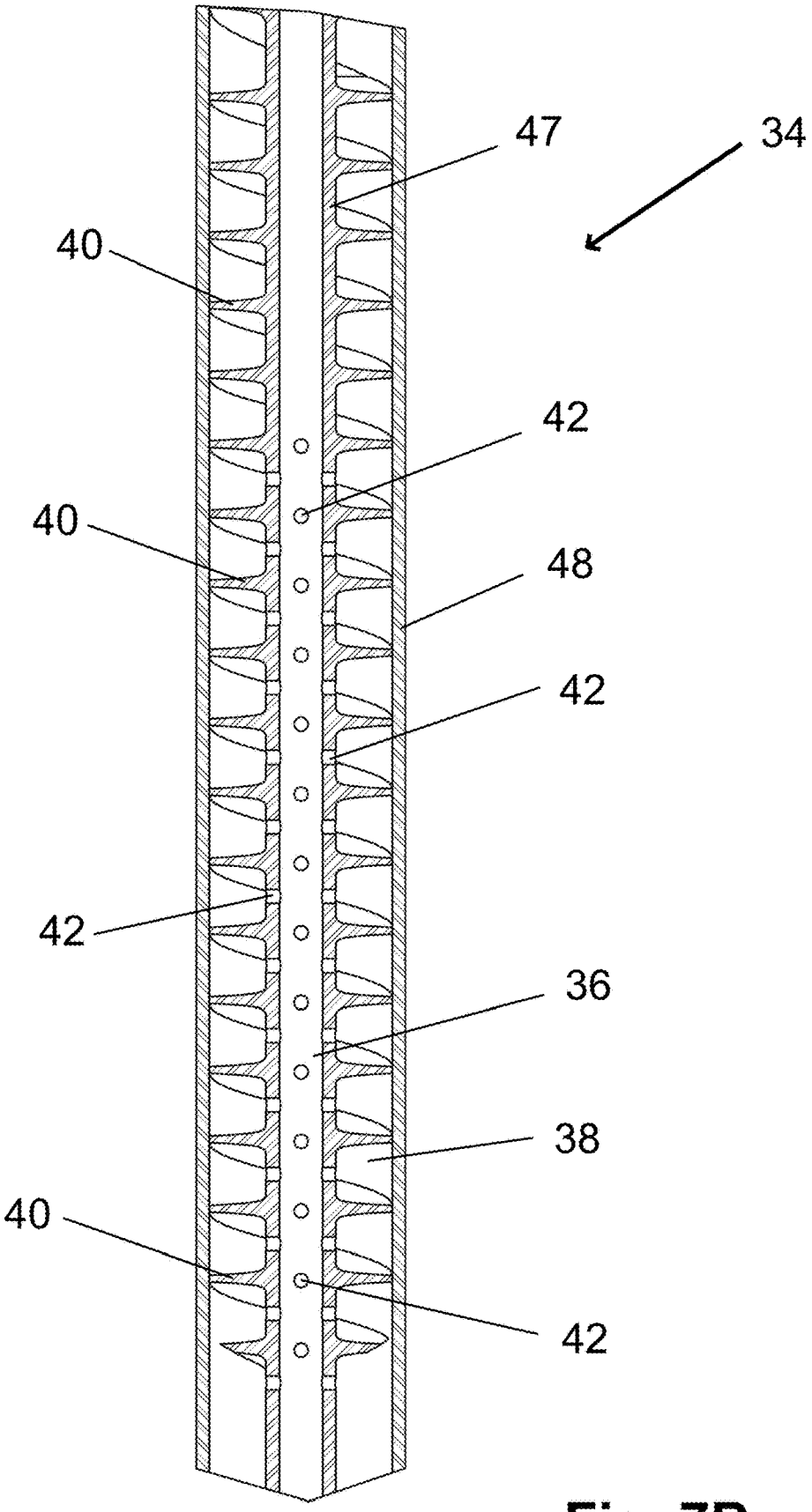
FIG. 7B is a detailed sectional view of a middle portion of the particle adjusting mechanism of FIG. 6.
Figure 7C:
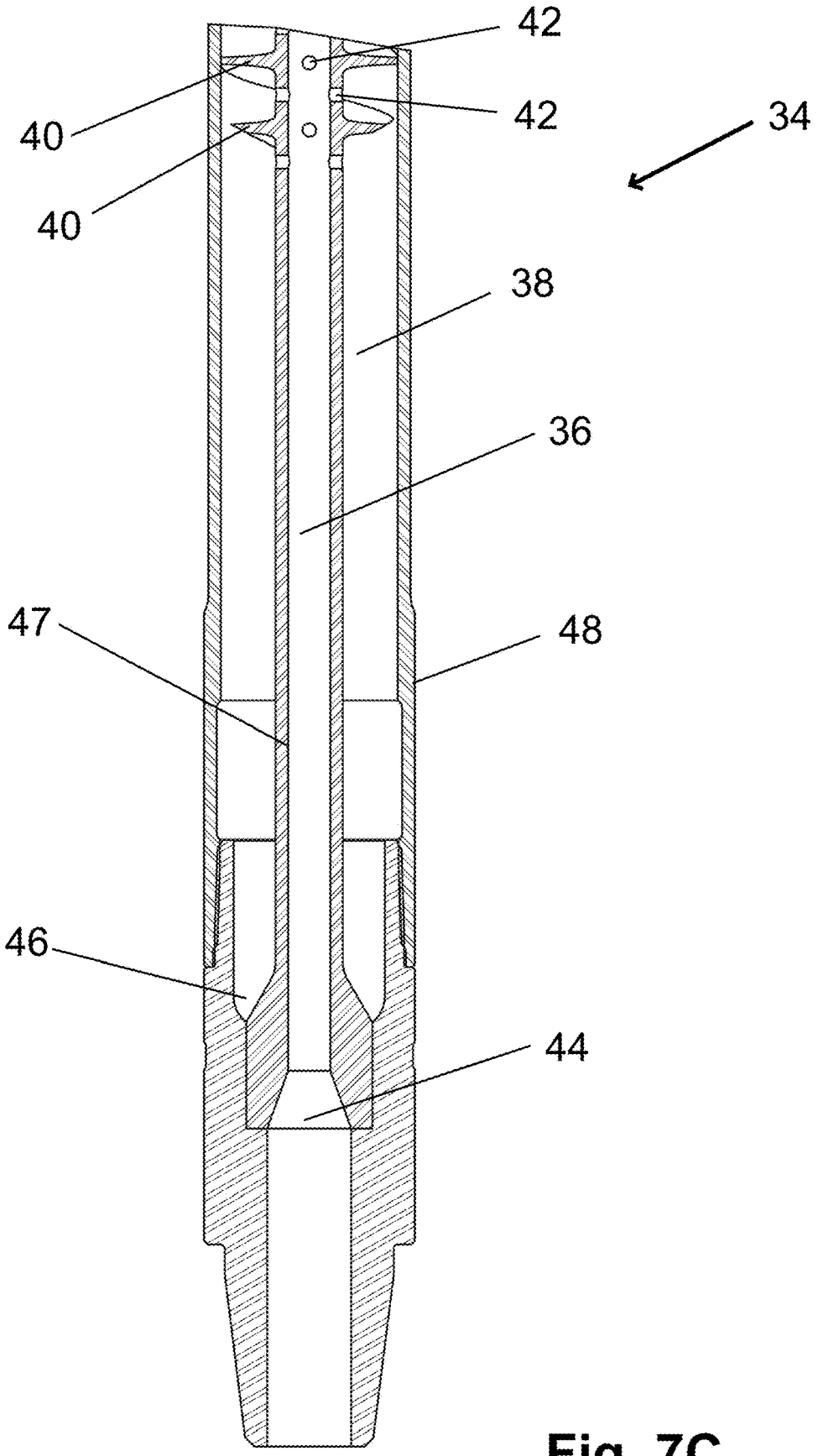
FIG. 7C is a detailed sectional view of a lower portion of the particle adjusting mechanism of FIG. 6.
Figure 8:
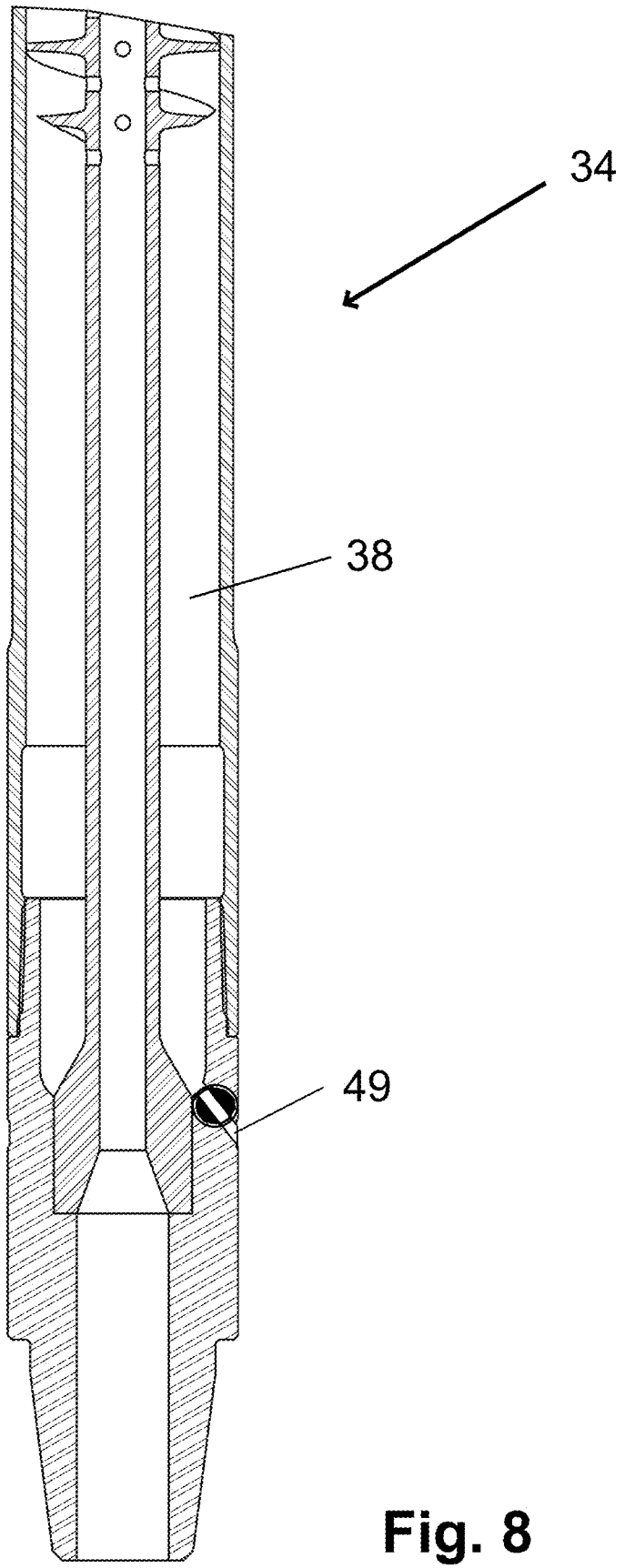
FIG. 8 is a detailed sectional view of a lower portion of an alternate embodiment of the particle adjustment mechanism including a cyclone with a flush port.

FIG. 4 illustrates one embodiment of particle adjusting mechanism 12 that includes a filter configured to reduce a concentration or amount of solid particles contained within a media. In the illustrated embodiment, particle adjusting mechanism 18 includes housing 20 and filter screen 22 containing plurality of openings 24. In certain embodiments, filter screen 22 may include open upstream end 26 and closed downstream end 28. Open upstream end 26 may provide a fluid passage into central filter cavity 30. Closed downstream end 28 may be closed or blocked by a seal or any other separate component secured thereto or by an integrated lateral portion of the filter screen 22. In these embodiments, a filter flow path includes the open upstream end 26, central filter cavity 30, openings 24, and annular space 32 between filter screen 22 and housing 20. A media flowing into particle adjusting mechanism 18 may be directed through open upstream end 26 of filter screen 22 and into central filter cavity 30. As the media flows through openings 24, at least a portion of any solid particles contained within the media are retained within central filter cavity 30. In this way, central filter cavity 30 provides a collection cavity in this embodiment. Accordingly, the media containing a reduced amount or concentration of the solid particles, or no solid particles, may flow into annular space 32 and flow downstream from particle adjusting mechanism 18 into a metal-to-metal positive displacement motor disposed downstream, such as motor 14 shown in FIG. 1. Openings 24 may be configured to cause central filter cavity 30 to retain any solid particles that do not fit through a motor gap in the downstream positive displacement motor. Accordingly, any solid particles remaining in the media in the treated condition flowing downstream from particle adjusting mechanism 18 are dimensioned to fit through the motor gap, thereby allowing those remaining solid particles to flow through the positive displacement motor without becoming wedged between the motor's metal rotor and metal stator. Alternatively, openings 24 may be configured to cause central filter cavity 30 to retain larger solid particles, and remaining solid particles in the media in the treated condition that do not fit through the motor gap may be crushed by the metal rotor and the metal stator of the positive displacement motor into a size or a shape that fits through the motor gap. In this embodiment, the remaining solid particles in the treated condition of the media may be softer particles or less abrasive particles that are not damaging to the metal rotor and the metal stator.

Alternatively, filter screen 22 may include a closed upstream end and an open downstream end. The closed upstream end may be closed or blocked by a seal or any other separate component secured thereto or by an integrated lateral portion of the filter screen 22. The open downstream end may provide a fluid passage out of central filter cavity 30. In these embodiments, a filter flow path includes annular space 32, openings 24, central filter cavity 30, and the open downstream end of filter screen 22. In these embodiments, a media flowing into particle adjusting mechanism 18 may be directed through annular space 32. As the media flows through openings 24 into central filter cavity 30, at least a portion of any solid particles contained within the media are retained within annular space 32. In this way, annular space 32 provides a collection cavity in this embodiment. Accordingly, the media containing a reduced amount or concentration of the solid particles may flow into central filter cavity 30 and flow downstream from particle adjusting mechanism 18 into a metal-to-metal positive displacement motor disposed downstream, such as motor 14 shown in FIG. 1. Openings 24 may be configured to cause annular space 32 to retain any solid particles that do not fit through a motor gap between the metal rotor and a lobe of the metal stator in the downstream positive displacement motor. Accordingly, any solid particles remaining in the media flowing downstream from this alternate embodiment of particle adjusting mechanism 18 are dimensioned to fit through the motor gap, thereby allowing any remaining solid particles to flow through the positive displacement motor without becoming wedged between the motor's metal rotor and metal stator. Alternatively, openings 24 may be configured to cause central filter cavity 30 to retain larger solid particles, and remaining solid particles in the media in the treated condition that do not fit through the motor gap may be crushed by the metal rotor and the metal stator of the positive displacement motor into a size or a shape that fits through the motor gap. In this embodiment, the remaining solid particles in the treated condition of the media may be softer particles or less abrasive particles that are not damaging to the metal rotor and the metal stator.

Solid particles collected in each embodiment of particle adjusting mechanism 18 may build up over time until the plurality of openings 24 become blocked. In some embodiments, the collected solid particles may be cleaned out by removing particle adjusting mechanism 18 from a downhole string in which it is secured and disassembling particle adjusting mechanism 18. In other embodiments, such as the embodiment illustrated in FIG. 5, the collected solid particles may be cleared out of particle adjusting mechanism 18 by opening flush port 33 that directs the solid particles from central filter cavity 30 (or annular space 32 in a separate embodiment) into an annulus of the wellbore beyond the outer surface of housing 20 of particle adjusting mechanism 18. Flush port 33 may be opened by an automatic activation without requiring any signal from or action at the surface of a wellbore, such as automatic activation in response to a predefined media pressure increase upstream of the filter in response to filled central filter cavity 30 (or annular space 32 in a separate embodiment). Alternatively, flush port 33 may be opened in response to a signal received from a surface of the wellbore. Such signals may be, but are not limited to, a sequence of pressure pulses (mud weight changes), flow rate changes, drill pipe rotation changes, or the use of RFID (radio-frequency identification) technology. Accordingly, these embodiments of particle adjusting mechanism 18 are not required to be removed from a wellbore for removing collected solid particles nor does particle adjusting mechanism 18 release collected solid particles into the downstream positive displacement motor 14.

In still other embodiments, the particle adjusting mechanism may include a first set of filter openings configured to retain a larger size range of solid particles and a second set of filter openings configured to retain a smaller size range of solid particles. The first and second set of filter openings may be disposed on the same filter screen. Alternatively, multiple filter screens may be employed to provide a graduated filtering effect.

Referring to FIGS. 6 and 7A-7C, another embodiment of a particle adjusting mechanism 12 may include a cyclone configured to reduce a concentration or amount of solid particles contained within a media. In the illustrated embodiment, particle adjusting mechanism 34 includes central cavity 36 and annular cavity 38, with one or more vanes 40 disposed in annular cavity 38. One or more lateral openings 42 fluidly connect annular cavity 38 and central cavity 36. Central cavity 36 includes closed upstream end 43 and open downstream end 44. Annular cavity 38 includes open upstream end 45 and closed downstream end 46. Particle adjusting mechanism 34 is configured to provide a centrifugal flow path through open upstream end 45 of annular cavity 38, downstream through annular cavity 38 between the one or more vanes 40, through the one or more lateral openings 42, into central cavity 38, and through open downstream end 44 of central cavity 36. The one or more vanes 40 may be configured to direct a media flow in a helical direction through the annular cavity to provide a centrifugal force that directs heavier solid particles outward away from the one or more lateral openings 42. In some embodiments, the one or more vanes 40 may be helically shaped, similar to a stationary Archimedes screw.

In certain embodiments, central cavity 36 is defined within inner sleeve 47 and annular cavity 38 is defined between inner sleeve 47 and housing 48. The one or more vanes 40 may be integrally formed with inner sleeve 47. Alternatively, the one or more vanes 40 may be provided by one or more separate components that are operatively connected to inner sleeve 47, housing 48, or both. Closed upstream end 43 may be closed by a separate component, by housing 48, by an integrally formed portion of inner sleeve 47, or by any combination thereof. Closed downstream end 46 may be closed by a separate component, by housing 48, by inner sleeve 47, or by any combination thereof. Housing 48 may be formed of multiple housing segments as illustrated or a single continuous housing segment.

A media containing solid particles flowing into the upstream end of particle adjusting mechanism 34 may flow through open upstream end 45 of annular cavity 38 and the centrifugal flow path. The centrifugal force generated by the media's flow in the helical direction between the one or more vanes 40 in the annular cavity 38 forces solid particles radially in an outward direction away from the one or more lateral openings 42 into central cavity 38. Accordingly, at least a portion of the solid particles contained in the media remains in annular cavity 38 while the remainder of the media flows through lateral openings 42 into central cavity 38. The removed solid particles remain in annular cavity 38 and are retained and collected by closed downstream end 46 of annular cavity 38. Additionally, the size of the one or more lateral openings 42 may function to prevent larger solid particles from flowing into the central cavity 36. The vanes 40 and the lateral openings 42 may be configured to cause annular cavity 38 to retain any solid particles that do not fit through a motor gap between the metal rotor and a lobe of the metal stator in the downstream positive displacement motor. The media containing a reduced amount or concentration, or no solid particles, continues flowing through the downstream outlet of particle adjusting mechanism 34 into a metal-to-metal positive displacement motor disposed downstream, such as motor 14 shown in FIG. 1. Any solid particles remaining in the media in the treated condition flowing downstream from particle adjusting mechanism 34 are dimensioned to fit through the motor gap or to be breakable without damage to the metal rotor and the metal stator, thereby allowing those remaining solid particles to flow through the positive displacement motor without becoming wedged between the motor's metal rotor and metal stator. Alternatively, the vanes 40 and the lateral openings 42 may be configured to cause annular cavity 38 to retain larger solid particles, and remaining (potentially softer) solid particles in the media in the treated condition that do not fit through the motor gap may be crushed by the metal rotor and the metal stator of the positive displacement motor into a size or a shape that fits through the motor gap.

Solid particles collected in annular cavity 38 may build up over time until the one or more lateral openings 42 become blocked. In some embodiments, the collected solid particles may be cleaned out of annular cavity 38 by removing particle adjusting mechanism 34 from a downhole string in which it is secured and disassembling particle adjusting mechanism 34. In other embodiments, such as the embodiment illustrated in FIG. 8, the collected solid particles may be cleared out of annular cavity 38 by opening flush port 49 that directs the solid particles from annular cavity 38 into an annulus of the wellbore beyond the outer surface of housing 48 of particle adjusting mechanism 34. Flush port 49 may be opened by an automatic activation without requiring any signal from or action at the surface of a wellbore, such as automatic activation in response to a predefined media pressure increase upstream of the cyclone in response to filled annular cavity 38. Alternatively, flush port 49 may be opened in response to a signal received from a surface of the wellbore. Such signals may be, but are not limited to, a sequence of pressure pulses (mud weight changes), flow rate changes, drill pipe rotation changes, or the use of RFID (radio-frequency identification) technology. Accordingly, these embodiments of particle adjusting mechanism 34 are not required to be removed from a wellbore for removing collected solid particles nor does particle adjusting mechanism 34 release collected solid particles into the downstream positive displacement motor 14.

Figure 9:
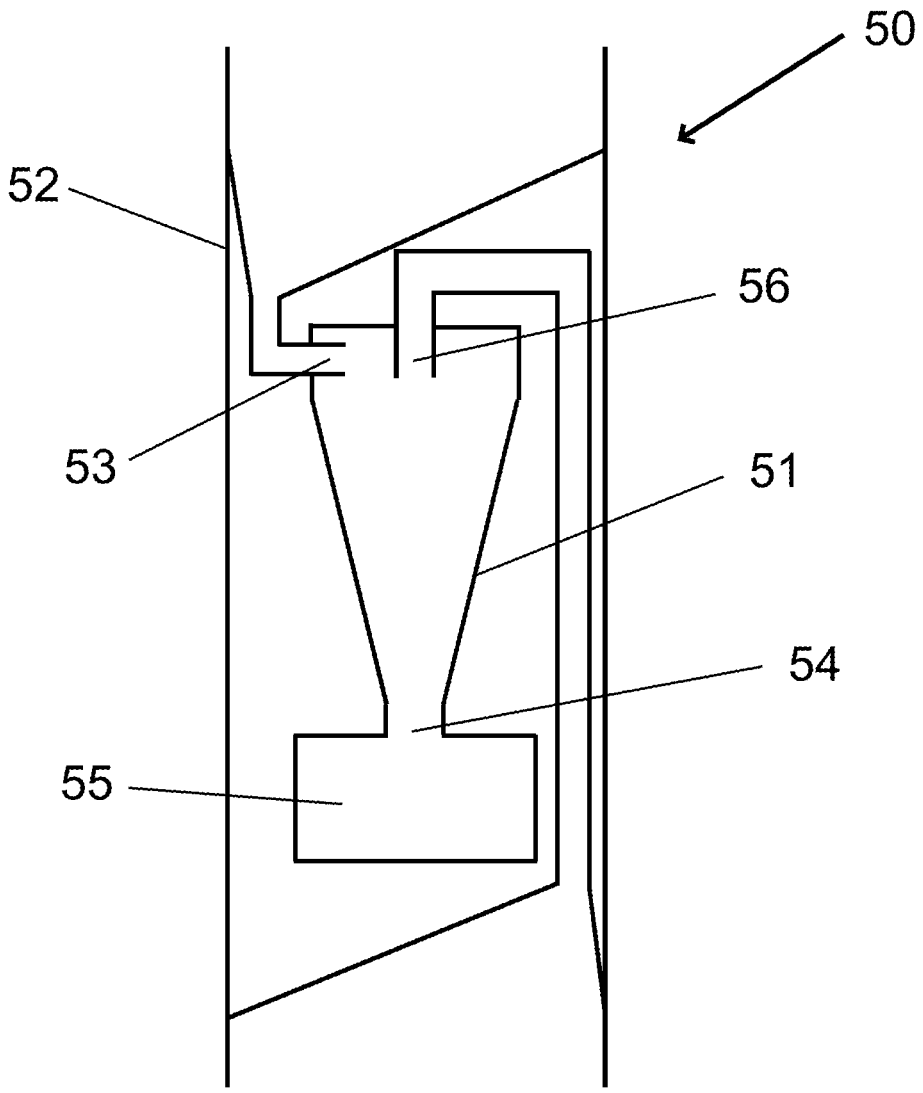
FIG. 9 is a schematic view of another embodiment of the particle adjustment mechanism including an alternate cyclone.

FIG. 9 illustrates another embodiment of particle adjusting mechanism 12 that includes a cyclone configured to reduce a concentration or amount of solid particles contained within a media. Particle adjusting mechanism 50 includes cone 51 disposed within housing 52. Tangential inlet 53 is fluidly connected to an upstream end of housing 52. As a media containing solid particles flows through particle adjusting mechanism 50, a portion or all of the solid particles contained in the media may settle and travel through underflow discharge 54 into collection vessel 55, while a liquid or gas portion of the media, optionally along with lighter solid particles, may rise and flow through vortex discharge 56. Vortex discharge 56 may be fluidly connected to a downstream end of housing 52. In this way, the cyclone of particle adjusting mechanism 12 may remove and collect at least a portion of any solid particles contained within a media flowing therethrough. In some embodiments, collected solid particles may be cleaned out of collection vessel 55 by removing particle adjusting mechanism 50 from a downhole string in which it is secured and disassembling particle adjusting mechanism 50. In other embodiments, the collected solid particles may be cleared out of collection vessel 55 without being removed from a wellbore by opening a flush port that directs the solid particles from collection vessel 55 into an annulus of the wellbore beyond the outer surface of housing 52 of particle adjusting mechanism 50. The flush port may be automatically opened or opened in response to a signal from a surface of the wellbore.

In still other embodiments, the particle adjusting mechanism may include a first cyclone configured to retain a larger size range of solid particles and a second cyclone configured to retain a smaller size range of solid particles. In these embodiments, multiple cyclones may be employed to provide a graduated separation effect.

Figure 10:
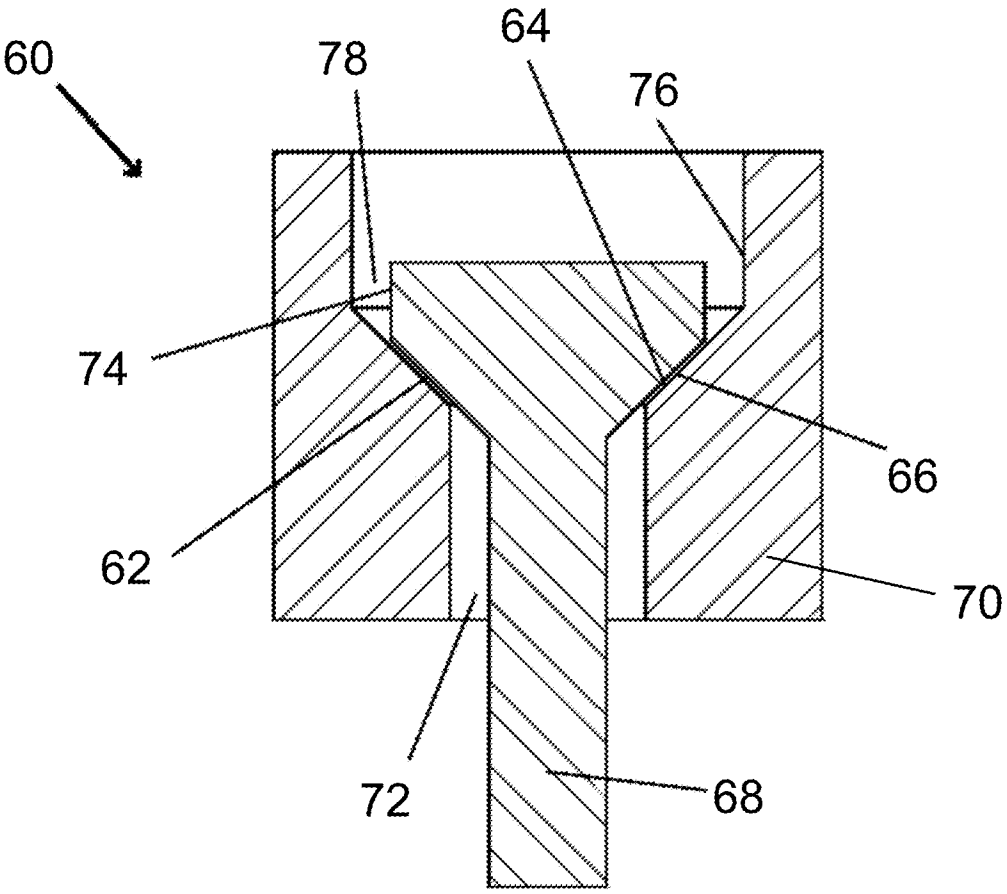
FIG. 10 is a sectional view of another embodiment of the particle adjusting mechanism including a crusher.

With reference now to FIG. 10, another embodiment of a particle adjusting mechanism 12 may include a crusher or a grinder configured to reduce a size of, reduce a dimension of, deform, or adjust a shape of a portion of any solid particles contained within a media. In the illustrated embodiment, particle adjusting mechanism 60 may include crushing surface 62 and second crushing surface 64. First and second crushing surfaces 62 and 64 may be spaced apart by a crushing space 66 that is sized to allow solid particles in a media to fit therein. In some embodiments, first and second crushing surfaces are reciprocally shaped. For example, first and second crushing surfaces 62 and 64 may both be tapered at the same angle of inclination, such as reciprocal conical-shaped surfaces. In other embodiments, first and second crushing surfaces 62 and 64 may have differing angles of inclination to provide a tapered crushing space 66 that decreases in the downstream direction. The tapered crushing space 66 of these embodiments may impart crushing forces on solid particles of varying size and shape.

First and second crushing surfaces 62 and 64 are configured for relative rotation there between while maintaining the same crushing space or at least a minimal predetermined crushing space. For example, first crushing surface 62 may move relative to second crushing surface 64 while maintaining crushing space 66 therebetween. Alternatively, second crushing surface 64 may move relative to first crushing surface 62 while maintaining crushing space 66 therebetween. The relative movement may be in any direction that causes first and second crushing surfaces 62 and 64 to impart crushing or grinding forces, such as, but not limited to, frictional and compressive forces. For example, the relative movement may be rotation, axial movement, eradicate movement, or any combination thereof, of one crushing surface relative to the other crushing surface. In the illustrated embodiment, first crushing surface 62 may be configured to rotate relative to second crushing surface 64. The crushing forces reduce the size or a dimension of at least a portion of any solid particles disposed in crushing space 66.

In some embodiments, such as the embodiment illustrated in FIG. 10, first crushing surface 62 may be formed on the expanded portion of mandrel 68 disposed within housing 70, and second crushing surface 64 may be formed on a tapered inner surface of housing 70. Rotation of mandrel 68 relative to housing 70 imparts crushing forces on solid particles disposed within crushing space 66. A media containing solid particles flowing into the upstream end of particle adjusting mechanism 60 may flow into housing 70 and into crushing space 66 between first and second crushing surfaces 62 and 64. The crushing forces generated by relative movement between crushing surfaces 62 and 64, such as with rotation of mandrel 68, may impart crushing forces on any solid particles disposed within crushing space 66. The crushing or grinding forces may reduce the size or at least a dimension of at least some of the solid particles contained in the media. The media containing smaller solid particles may continue to flow downstream from crushing space 66 through annular space 72 between mandrel 68 and housing 70 and through the downstream outlet of particle adjusting mechanism 60.

In certain embodiments, particle adjusting mechanism 60 may include additional crushing surfaces, such as crushing surface 74 and crushing surface 76 with crushing space 78 disposed therebetween in the illustrated embodiment. Relative movement between the additional crushing surfaces 74, 76 and/or between one of the additional crushing surfaces and first or second crushing surfaces 62, 64 may also impart crushing forces on any solid particles disposed within crushing space 78 therebetween.

In other embodiments, the particle adjusting mechanism may include a first crusher portion configured to crush a larger size range of solid particles and a second crusher portion configured to crush a smaller size range of solid particles. In these embodiments, multiple crushers may be employed to provide a graduated crushing effect.

Figure 11:
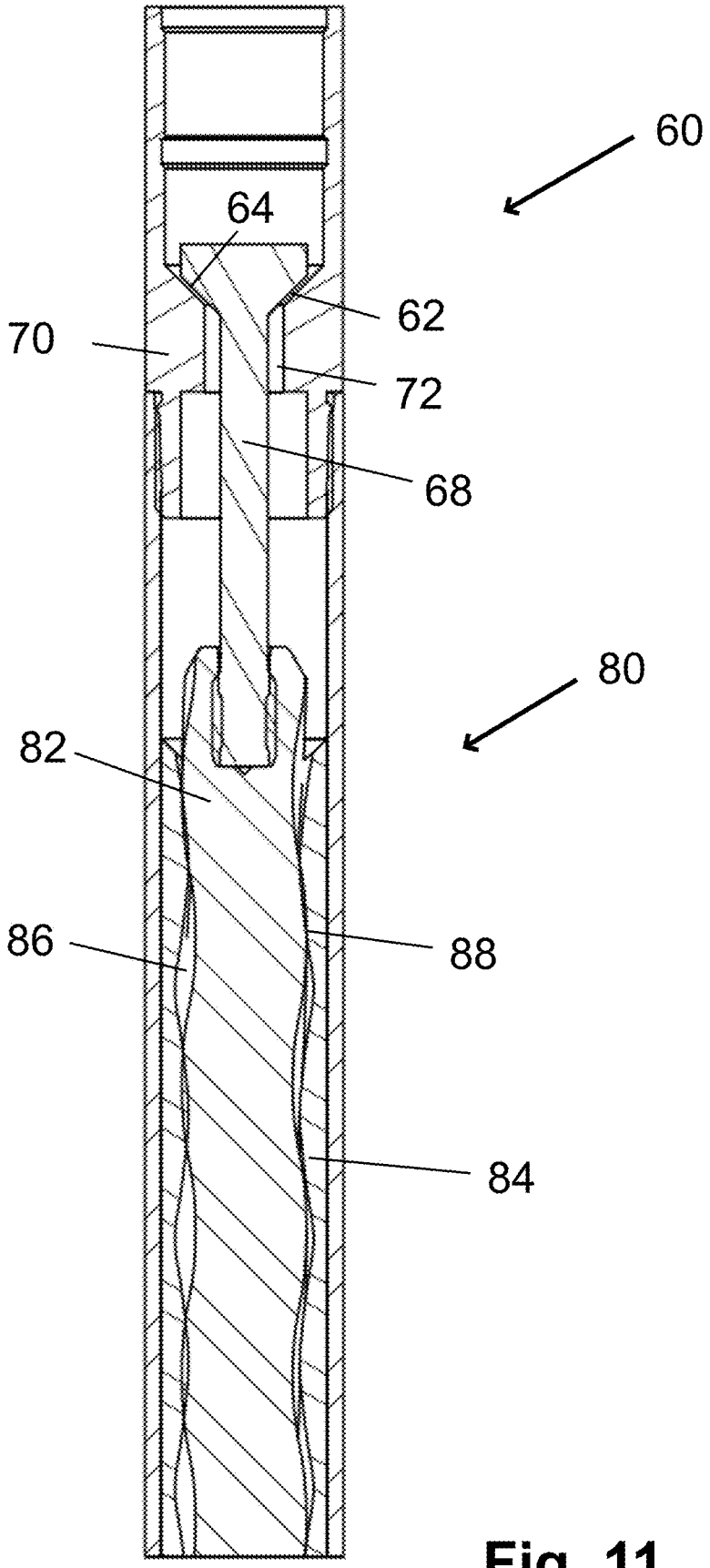
FIG. 11 is a sectional view of another embodiment of the particle adjusting mechanism including a crusher configured to rotate with a rotor of a positive displacement motor.

With reference to FIG. 11, particle adjusting mechanism 60 may be secured upstream of, or integrally formed upstream of, metal-to-metal power section 80 of a positive displacement motor. Power section 80 may include metal rotor 82 at least partially disposed within metal stator 84. In the illustrated embodiment, mandrel 68 may be rotationally secured to an upstream end of rotor 82 such that mandrel 68 rotates with rotation of rotor 82. Mandrel 68 can be a flexible shaft or a CV-joint to offset the eccentric torsional movement of the rotor.

One or more cavities 86 are defined between metal rotor 82 and metal stator 84. Media flow through cavity 86 may cause rotor 82 to rotate, thereby rotating mandrel 68. In this way, rotor 82 may provide the rotational movement of first crushing surface 62 on mandrel 68 relative to second crushing surface 64 on housing 70, thereby imparting crushing forces on any solid particles disposed within crushing space 66.

As described above, a media containing solid particles flowing through particle adjusting mechanism 60 may flow into crushing space 66. The crushing forces caused by the rotation of first crushing surface 62 on mandrel 68 relative to second crushing surface 64 within housing 70 may grind, deform, and/or crush a portion of any solid particles contained in the media in order to reduce the size or at least one dimension of the solid particles. For example, the solid particles may be deformed by changing the shape of at least a portion of the solid particles, such as by making solid particles flatter (i.e., reducing at least the thickness of the solid particles). The media containing smaller solid particles may then continue flowing downstream through annular space 72 and into cavity 86. Media flow through cavity 86 causes rotor 82 and mandrel 68 to rotate relative to stator 84 and housing 70, respectively. The media flowing through cavity 86 downstream of particle adjusting mechanism 60 contains smaller solid particles, which reduces or eliminates the possibility that any solid particles will become stuck within motor gap 88 between the sealing line of the metal rotor 82 and the lobes of metal stator 84. Crushing space 66 may be configured to reduce the size of, at least one dimension of, or a shape of solid particles to less than a size of motor gap 88. In some embodiments, motor gap 88 may have a default size of 0.005 inches to 0.020 inches. Particle adjusting mechanism 60 may be configured to adjust a solid particle condition of the media into a treated condition in which any remaining solid particles will travel through motor gap 88 without widening the motor gap to a failure gap size. The failure gap size may be a size of motor gap 88 that causes metal rotor 82 to lock up within metal stator 84 or to slow down to a reduced rotational rate that renders drilling inefficient. In certain embodiments, the failure gap size of motor gap 88 may be greater than 0.020 inches. In some embodiments, the remaining solid particles, if any, in the treated condition of the media flowing downstream from particle adjusting mechanism 60 are dimensioned to fit through motor gap 88, thereby allowing the solid particles to flow through power section 80 of the positive displacement motor without becoming wedged in motor gap 88 between metal rotor 82 and metal stator 84. Alternatively, metal rotor 82 and metal stator 84 may crush any remaining solid particles in the treated condition of the media flowing downstream from particle adjusting mechanism 60 into a size and/or a shape that fits through motor gap 88.

Figure 12:
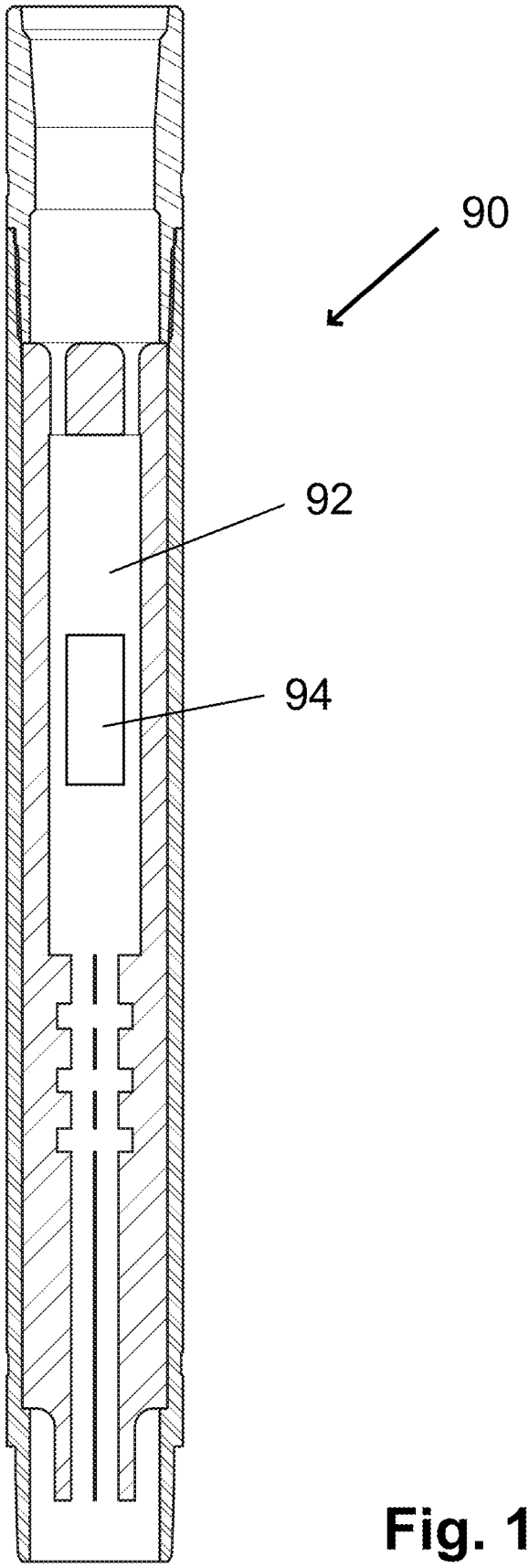
FIG. 12 is a sectional view of yet another embodiment of the particle adjusting mechanism including a treatment chamber.

Referring to FIG. 12, yet another embodiment of a particle adjusting mechanism 12 may include a chemical treatment chamber configured to dissolve or chemically react a portion of any solid particles in a media. In the illustrated embodiment, particle adjusting mechanism 90 includes treatment chamber 92. A treatment substance 94 may be disposed in treatment chamber 92. The treatment substance may be any material configured to dissolve solid particles, chemically react with solid particles, or change at least one dimension of solid particles in any other manner. In some embodiments, the treatment substance may be configured to dissolve at least a portion of any solid particles contained in a media as the media flows through treatment chamber 92 of particle adjusting mechanism 90. For example, the treatment material may be sodium chloride, which may dissolve and/or disperse at least a portion of any clay contained in a media flowing through treatment chamber 92. Many other embodiments of treatment media configured to dissolve solid particles will be clear to skilled artisans. The media containing dissolved solid particles continues flowing through the downstream outlet of particle adjusting mechanism 90.

In other embodiments, the treatment substance may be configured to chemically react with at least a portion of any solid particles contained in a media as the media flows through treatment chamber 92 in order to form one or more liquid reaction products, one or more gas reaction products, or one or more solid reaction products with smaller sizes, or at least one smaller dimension, than the solid particles entering particle adjusting mechanism 90. For example, the treatment material may be hydrochloric acid, which may chemically react with at least a portion of any chalk contained in a media flowing through treatment chamber 92. Many other embodiments of treatment media configured to dissolve solid particles will be clear to skilled artisans. The media containing the reaction products continues flowing through the downstream outlet of particle adjusting mechanism 90 into a metal-to-metal positive displacement motor disposed downstream, such as motor 14 shown in FIG. 1.

In other embodiments, the particle adjusting mechanism may include a first treatment substance contained in a first treatment chamber of the particle adjusting mechanism and a second treatment substance contained in a second treatment chamber of the particle adjusting mechanism. A first chemical subset of the solid particles in the media may be dissolved or chemically reacted with the first treatment substance, and a second chemical subset of the solid particles in the media may be dissolved or chemically reacted with the second treatment substance. In these embodiments, multiple treatment chambers may be employed to provide a sequenced solid particle adjusting effect.

Figure 13:
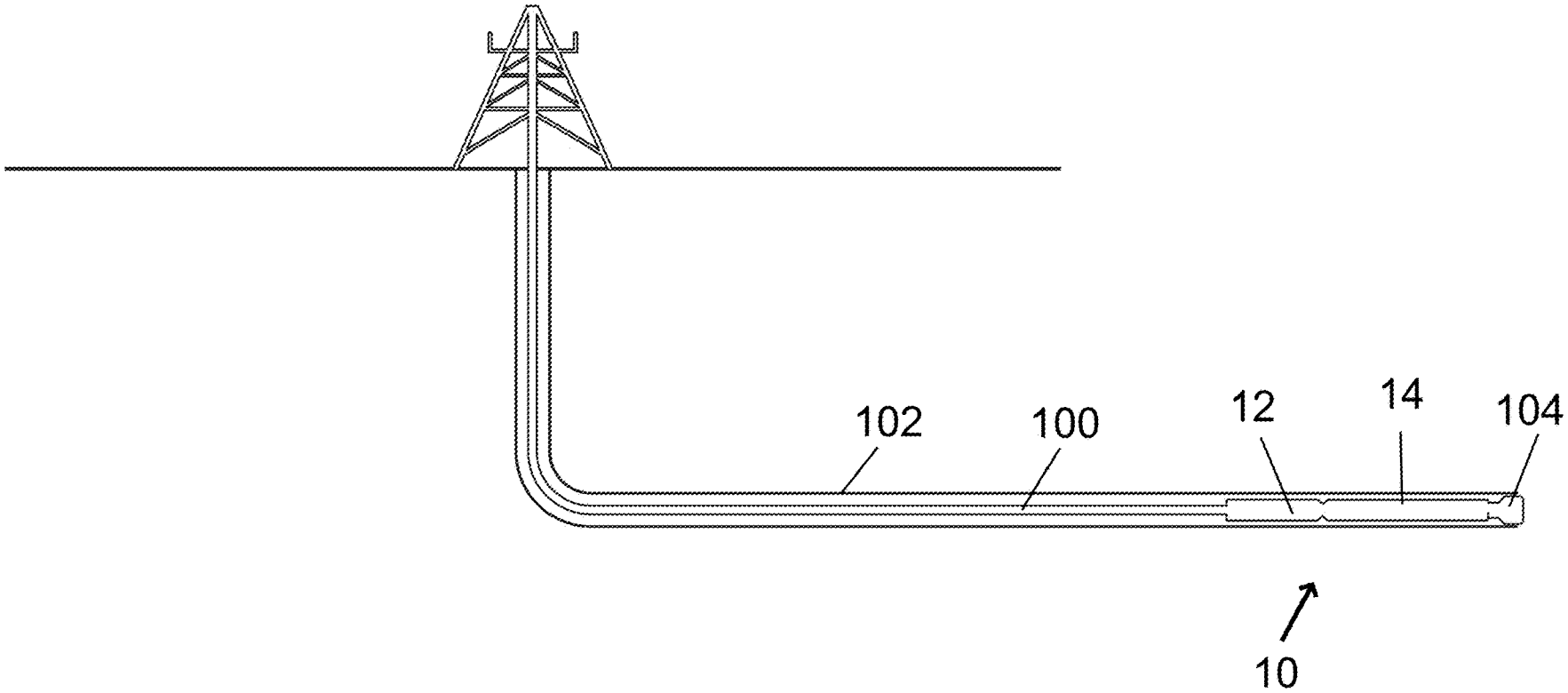
FIG. 13 is a plan view of one embodiment of the drilling assembly of the present disclosure secured to a downhole string within a subterranean wellbore.

With reference to FIG. 13, drilling assembly 10 may be secured to a distal end of downhole string 100 for use in drilling wellbore 102. In this embodiment, particle adjusting mechanism 12 may be connected upstream of metal-to-metal positive drilling motor 14, as illustrated in FIG. 1. Particle adjusting mechanism 12 may be any of the embodiment disclosed herein, including without limitation particle adjusting mechanism 18, particle adjusting mechanism 34, particle adjusting mechanism 60, or particle adjusting mechanism 90. Wellbore 102 may be a high temperature wellbore, such as but not limited to wellbores at temperatures between and including 320° F. and 1110° F., or any subrange therein.

A drilling media may be pumped through downhole string 100. As the drilling media flows through particle adjusting mechanism 12, a solid particle condition of the drilling media may be adjusted to a treated condition in which any remaining solid particles fit through a motor gap of positive displacement motor 14. For example, all or a portion of the solid particles within the drilling media may be removed or modified in order to change at least one dimension by crushing, grinding, deforming, dissolving, or chemically reacting as described above. The drilling media (i.e., the remaining liquid or gas components, along with any remaining original or modified solid particles) flows downstream through metal-to-metal positive displacement motor 14 and drill bit 104. Metal-to-metal positive displacement motor 14 is capable of withstanding the high temperatures within wellbore 102 and configured to allow use of drilling media containing solid particles within downhole string 100, all while preventing or minimizing any abrasive damage or blockages within motor 14 by adjusting the solid particles to fit within the motor gap between the metal rotor and the metal stator before the drilling media and solid particles (if any) flow through motor 14.

Particle adjusting mechanism 12 disclosed herein, including all disclosed embodiments, may be secured within any portion of downhole string 100 in order to adjust a solid particle condition contained in the drilling media before it flows through any tool in the downhole string 100, such as but not limited to drilling motors, percussion assemblies, vibration assemblies, or any other tool including a metal rotor and a metal stator. In some embodiments, multiple particle adjusting mechanisms 12 may be used within a single downhole string 100.

As used herein, "solid particles" means any solid materials contained within a media, including but not limited to clay, sand, barite, hematite, cuttings, rock fragments, or metal fragments from the equipment. As used herein, "solid particle condition" means a condition of all of the solid particles contained in a media, including but not limited to an amount, a dimension, a shape, or a chemical condition. As used herein, "media" or "drilling media" means any liquid or compressible gas, which may include solid particles. As used herein, "treated condition" means a condition of the drilling media or a condition of any solid particles contained in the drilling media after adjustment of a solid particle condition by the particle adjusting mechanism. As used herein, "adjust" in reference to solid particles or solid particle condition means to reduce an amount or concentration of, reduce a size, reduce at least one dimension, deform, change a shape, dissolve, or chemically react to produce one or more reaction products, which may include one or more gas substances, liquid substances, or solid particles having a reduced size or at least one reduced dimension relative to the initial solid particle reactants, or any combination thereof. As used herein, "crusher" means any device configured to break up, change the shape of, or deform solid particles by pressing the particles between two surfaces or by applying frictional forces to the particles in multiple directions. As used herein, "downhole string" shall include a series of drill string or pipe segments and a coiled tubing line, along with any components secured thereto. As used herein, "plurality" means two or more. As used herein, "above" and "below" shall each be construed to mean upstream and downstream, such that the directional orientation of the device is not limited to a vertical arrangement.

Except as otherwise described or illustrated, each of the components in this device may have a generally cylindrical shape and may be formed of steel or another metal. Portions of drilling system 10 may be formed of a wear resistant material, such as tungsten carbide, ceramics, or ceramic coated steel.

Each device described in this disclosure may include any combination of the described components, features, and/or functions of each of the individual device embodiments. Each method described in this disclosure may include any combination of the described steps in any order, including the absence of certain described steps and combinations of steps used in separate embodiments. For example, the drilling assembly may include any combination of one or more sets of filters, one or more sets of cyclones, one or more sets of crushers, and one or more sets of treatment chambers. Any of these combinations may be configured to adjust a solid particle condition progressively and/or in a graduated manner (e.g., progressively smaller remaining solid particles in the treated condition of the media. Any range of numeric values disclosed herein includes any subrange therein.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

The invention claimed is:

1. A drilling assembly comprising:

a positive displacement drilling motor containing a metal stator, a metal rotor at least partially disposed within the metal stator, and a motor gap defined between the metal rotor and a lobe of the metal stator; and a particle adjusting mechanism having a housing positioned upstream of the metal stator of the positive displacement drilling motor, wherein the particle adjusting mechanism is configured to adjust a solid particle condition of a media flowing through the particle adjusting mechanism to a treated condition in which any remaining solid particles will travel through the motor gap without widening the motor gap to a failure gap size;

wherein in the event there are remaining solid particles in the treated condition having a size or shape that will not fit through the motor gap, the metal rotor and the metal stator are configured to crush any remaining solid particles in the treated condition into a size or a shape that fits through the motor gap.

2. The drilling assembly of claim 1, wherein the failure gap size is a size of the motor gap that causes the metal rotor to lock up within the metal stator or to slow down to a reduced rotational rate that renders drilling inefficient.

3. The drilling assembly of claim 1, wherein the failure gap size is greater than 0.020 inches.

4. The drilling assembly of claim 1, wherein a size of the motor gap is 0.005 inches to 0.020 inches.

5. The drilling assembly of claim 1, wherein the solid particle condition is an amount of solid particles contained in the media; wherein the particle adjusting mechanism is configured to remove at least a portion of any solid particles contained in the media.

6. The drilling assembly of claim 5, wherein the particle adjusting mechanism includes a filter configured to collect the portion of any solid particles contained in the media.

7. The drilling assembly of claim 6, wherein the filter includes a filter screen containing a plurality of openings therethrough, a collection cavity, and a second space; wherein a filter flow path extends from the collection cavity, through the plurality of openings in the filter screen, and into the second space; wherein the collection cavity is configured to retain the portion of any solid particles contained in the media as the media flows through the filter flow path.

8. The drilling assembly of claim 5, wherein the particle adjusting mechanism includes a cyclone configured to collect the portion of any solid particles contained in the media.

9. The drilling assembly of claim 8, wherein the cyclone includes a central cavity, an annular cavity, one or more vanes disposed in the annular cavity, and one or more lateral openings fluidly connecting the annular cavity and the central cavity; wherein a centrifugal flow path extends between the one or more vanes in the annular cavity, through the one or more lateral openings, and into the central cavity; wherein the vanes are configured to generate a centrifugal force upon a flow of the media between the vanes; wherein the annular cavity is configured to retain the portion of any solid particles contained in the media as the media flows through the one or more lateral openings.

10. The drilling assembly of claim 9, wherein the one or more vanes are helically shaped.

11. The drilling assembly of claim 8, wherein the cyclone includes a cone and a tangential inlet.

12. The drilling assembly of claim 1, wherein the solid particle condition is a size, a dimension, or a shape of any solid particles contained in the media; wherein the particle adjusting mechanism is configured to reduce the size, reduce the dimension, deform, or modify the shape of at least a portion of any solid particles contained in the media.

13. The drilling assembly of claim 12, wherein the particle adjusting mechanism includes a crusher configured to reduce the size, reduce the dimension, deform, or modify the shape of the portion of any solid particles contained in the media.

14. The drilling assembly of claim 13, wherein the crusher includes a crushing space defined between a first surface and a second surface, wherein the first surface and the second surface are configured to impart crushing or grinding forces on any solid particles positioned in the crushing space upon movement of the first surface relative to the second surface.

15. The drilling assembly of claim 14, wherein the first surface is defined by a mandrel that is rotationally secured to the metal rotor, wherein the crushing or grinding forces are generated by a rotation of the mandrel and the first surface upon a rotation of the metal rotor.

16. The drilling assembly of claim 1, wherein the solid particle condition is a chemical condition of any solid particles contained in the media; wherein the particle adjusting mechanism includes a treatment chamber containing a treatment substance configured to dissolve at least a portion of any solid particles or to chemically react with at least a portion of any solid particles to produce one or more liquid reaction products, one or more gas reaction products, one or more solid reaction products, or a combination thereof; wherein the one or more solid reaction products have a reduced size, a reduced dimension, or a modified shape.

17. The drilling assembly of claim 1, wherein the positive displacement drilling motor is a Moineau motor.

18. A method of drilling a subterranean wellbore, comprising the steps of:

a) providing a drilling assembly comprising: a positive displacement drilling motor containing a metal stator, a metal rotor at least partially disposed within the metal stator, and a motor gap defined between the metal rotor and a lobe of the metal stator; and a particle adjusting mechanism having a housing positioned upstream of the metal stator of the positive displacement drilling motor; wherein in the event there are remaining solid particles in a treated condition having a size or shape that will not fit through the motor gap, the metal rotor and the metal stator are configured to crush any remaining solid particles in the treated condition into a size or a shape that fits through the motor gap;

b) flowing a media through the particle adjusting mechanism;

c) adjusting a solid particle condition of the media into the treated condition using the particle adjusting mechanism; and d) flowing the media in the treated condition through the positive displacement drilling motor to rotate the metal rotor; wherein any remaining solid particles in the treated condition of the media travel through the motor gap without widening the motor gap to a failure gap size that causes the metal rotor to lock up within the metal stator or to slow down to a reduced rotational rate that renders drilling inefficient.

19. The method of claim 18, wherein in step (d) any remaining solid particles in the treated condition of the media fit through the motor gap.

20. The method of claim 18, wherein in step (d) rotation of the metal rotor rotates a drill bit operatively connected thereto; and further comprising the step of:

e) drilling a subterranean wellbore with the rotation of the drill bit.

21. The method of claim 20, wherein a temperature within the subterranean wellbore is between 320° F. and 1110° F.

22. The method of claim 18, wherein in step (c) the solid particle condition is an amount of solid particles contained in the media; wherein step (c) further comprises removing at least a portion of any solid particles contained in the media using the particle adjusting mechanism.

23. The method of claim 22, wherein step (c) further comprises collecting the portion of any solid particles contained in the media in a cavity of a filter in the particle adjusting mechanism.

24. The method of claim 22, wherein step (c) further comprises collecting the portion of the solid particles of a first size range contained in the media using a first set of filter openings in the particle adjusting mechanism, and collecting the portion of the solid particles of a second size range contained in the media using a second set of filter openings downstream of the first set of filter openings in the particle adjustment mechanism; wherein the first size range is larger than the second size range.

25. The method of claim 22, wherein step (c) further comprises collecting the portion of any solid particles contained in the media in a cavity of a cyclone in the particle adjusting mechanism.

26. The method of claim 22, wherein step (c) further comprises collecting the portion of the solid particles of a first size range contained in the media using a first cyclone in the particle adjusting mechanism, and collecting the portion of the solid particles of a second size range contained in the media using a second cyclone downstream of the first cyclone in the particle adjustment mechanism; wherein the first size range is larger than the second size range.

27. The method of claim 18, wherein in step (c) the solid particle condition is a size, a dimension, or a shape of any solid particles contained in the media; wherein step (c) further comprises reducing the size, reducing the dimension, deforming, or modifying the shape of at least a portion of any solid particles contained in the media by the particle adjusting mechanism.

28. The method of claim 18, wherein step (c) further comprises crushing the portion of the solid particles of a first size range contained in the media using a first crusher portion in the particle adjusting mechanism, and crushing the portion of the solid particles of a second size range contained in the media using a second crusher portion downstream of the first crusher portion in the particle adjusting mechanism.

29. The method of claim 18, wherein in step (c) the solid particle condition is a chemical condition of any solid particles contained in the media; wherein step (c) further comprises dissolving or chemically reacting at least a portion of any solid particles contained in the media with a treatment substance contained in a treatment chamber of the particle adjusting mechanism.

30. The method of claim 18, wherein step (c) further comprises dissolving or chemically reacting the portion of the solid particles of a first chemical subset contained in the media using a first treatment substance contained in a first treatment chamber of the particle adjusting mechanism, and dissolving or chemically reacting the portion of the solid particles of a second chemical subset contained in the media using a second treatment substance contained in a second treatment chamber of the particle adjusting mechanism.

* * * * *